United States Patent [19]

Nishitsuji et al.

[11] Patent Number: 4,566,865

[45] Date of Patent: Jan. 28, 1986

[54] CLOSED TYPE COMPRESSOR

[75] Inventors: Kazuichi Nishitsuji, Kawasaki; Eiichi Aikawa; Yukio Haraguchi, both of Yokohama, all of Japan

[73] Assignee: Kabushiki Kaisha Toshiba, Kawasaki, Japan

[21] Appl. No.: 634,495

[22] Filed: Jul. 26, 1984

[30] Foreign Application Priority Data

Jul. 29, 1983 [JP] Japan ..... 58-137578

[51] Int. Cl.[4] ..... F04B 35/04; F16M 1/02

[52] U.S. Cl. ..... 417/363; 417/415; 417/902; 248/674; 248/300; 310/89; 310/91; 29/150

[58] Field of Search ..... 417/363, 415, 902, 410, 417/360; 310/91, 90, 89; 248/674, 560, 300; 72/379; 29/150

[56] References Cited

U.S. PATENT DOCUMENTS

| | | | |
|---|---|---|---|
| 3,075,686 | 1/1963 | Steinhagen | 417/363 |
| 3,206,148 | 9/1965 | Longsworth | 310/89 |
| 3,326,503 | 6/1967 | Bade | 248/300 |
| 3,516,627 | 6/1970 | Gable et al. | 248/560 |
| 3,606,594 | 9/1971 | Lewis et al. | 417/415 |
| 4,097,012 | 6/1978 | McIntyre | 248/674 |

FOREIGN PATENT DOCUMENTS

| | | | |
|---|---|---|---|
| 2741664 | 3/1979 | Fed. Rep. of Germany | 417/415 |
| 140211 | 12/1976 | Japan . | |
| 147010 | 12/1976 | Japan . | |
| 159007 | 12/1976 | Japan . | |

*Primary Examiner*—Cornelius J. Husar
*Assistant Examiner*—Peter M. Cuomo
*Attorney, Agent, or Firm*—Cushman, Darby & Cushman

[57] ABSTRACT

A closed type compressor comprises a case, a frame provided within the case, and a compressor and an electric motor, both of which are attached to the frame. The frame is constituted by an elongated sheet material member and a plurality of embossed portions integrally formed at the positions of the sheet material member capable of being seen by the eye both from above and from below and used to mount thereon the compression means and the motor means, respectively. The sheet material member is comprised of a central portion, leg portions formed by bending end portions of the sheet material member substantially perpendicular thereto, and ends formed by bending tip ends of the leg portions substantially perpendicular thereto so as to face the central portion.

7 Claims, 9 Drawing Figures

CLOSED TYPE COMPRESSOR

BACKGROUND OF THE INVENTION

The present invention relates to a closed type compressor for use in refrigeration and, more particularly, to a closed type compressor which has an improved frame for retaining a compression means and an electric motor means in place.

A closed type compressor is constructed such that a compression means comprised of a cylinder and piston and an electric motor means comprised of a rotor and stator are provided within a case, whereby the piston of the compression means is driven by a crank shaft attached to the rotor so as to compress a cooling medium within the cylinder.

The compression means and electric motor means are mounted on a frame located within the case, said frame being retained in place within the case by means of, for example, a supporting member. This frame is the most basic element of all constituent elements of the compressor, and all of the other constituent elements are mounted with that frame used as a mounting base. For this reason, the method of mounting the frame is required to enable a high precision mounting of the frame in order to precisely locate the respective mounting positions for the compression means and motor means. Besides, the frame is also required to have a sufficient rigidity for supporting the compression means and motor means.

Conventionally, said frame is made principally of cast iron or the like and its rigidity is maintained by casting while, on the other hand, its precision is maintained by mechanical fabrication. However, where said frame is formed by casting, it becomes mechanically sound but fragile. As a result, the thickness of the resultant frame becomes large and the shape thereof also becomes large. Further, since the frame is mechanically fabricated after it has been cast, the fabrication cost becomes high.

Recently the demand is for a closed type compressor small in size, light in weight and low in cost, and, from this point of view as well, it is not preferable that the frame be formed by a casting. For this reason, a method of making the frame by plastic formation has been proposed. However, since such plastic formation is effected mainly by bending and drawing, it is difficult to maintain the precisions involved (particularly, flat plane, parallelism, dimension). Besides, it is impossible to obtain a frame having a sufficiently high rigidity, and it is virtually impossible to make the frame in the form of an integral unit by said plastic formation.

SUMMARY OF THE INVENTION

The present invention has been accomplished in view of these prior art problems. An object of the present invention is to provide a closed type compressor which uses a frame of high precision, rigidity, and strength.

DETAILED DESCRIPTION OF THE PREFERRED EMBODIMENT

A closed type compressor according to a preferred embodiment of the present invention will now be described with reference to the appended drawings.

Figure 1:
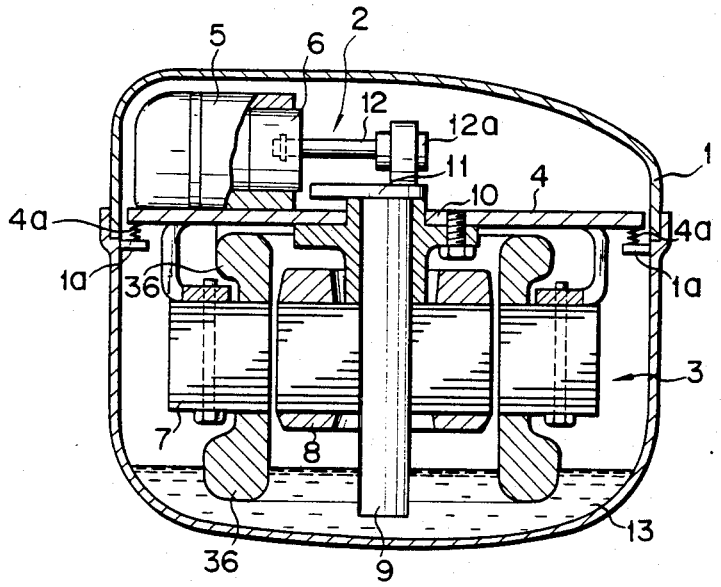
FIG. 1 is a sectional view of a closed type compressor according to an embodiment of the invention.

FIG. 1 shows a section of the entire closed type compressor of the present invention. In this figure, the reference numeral 1 denotes a case wherein a known compression means or compressor 2 and electric motor means or electric motor 3 are received in a state such that both of them are fixed to a frame 4. The compression means 2 is comprised of a cylinder 5 and a piston 6 and a cooling medium in the cylinder 5 is compressed by a reciprocating movement of the piston 6. The motor means 3 is comprised of an annular stator 7 and a rotor 8 adapted to be rotated within that stator. The rotating force of the rotor 8 is transmitted to the piston 6 of the compression means 2 through a crank shaft 9, whereby to move the piston 6 reciprocally.

A frame 4 is elastically supported on the case 1 by means of supporting members. This supporting means in this embodiment is constituted by protruded portions 1*a* integrally formed on an inner wall of the case 1, and springs 4*a* having lower ends fixed to upper surfaces of said protruded portions and upper ends connected to the undersides of end portions of the frame 4, respectively. On the upside of the frame 4, the cylinder 5 of the compression means 2 is mounted and, on the downside thereof, the stator 7 of the motor means 3 is mounted.

The crank shaft 9 coaxially supports the rotor 8 at its lower part and is rotatably supported by a bearing 10 mounted on the frame 4. The upper end portion of the crank shaft 9 is extended through the frame 4. A balance weight 11 is formed on a portion of the crank shaft 9 located on the upside of the frame 4 and, on this balance weight 11, a crank pin (not shown) is provided at the position deviated from a rotary axis of the crank shaft 9. That crank pin 12*a* is connected with a connecting rod 12 of the piston 6.

The case 1 is formed at its lower part with an oil reservoir 13. The oil in the oil reservoir 13 is supplied by an oil supply means, not shown, to the moving parts such as said bearing, etc., thereby lubricating such parts.

The frame 4 supports the cylinder 5 of the compression means 2 at its upper side and supports the stator 7 of the motor means 3 at its lower side and yet supports the bearing 10 for supporting the crank shaft 9 at its middle part. The frame 4, which is mounted with the cylinder 5, stator 7 and bearing 10, is formed with embossed portions, as later described, attached to the compression means 2 and motor means 3 by means of, for example, bolts.

Figure 2:
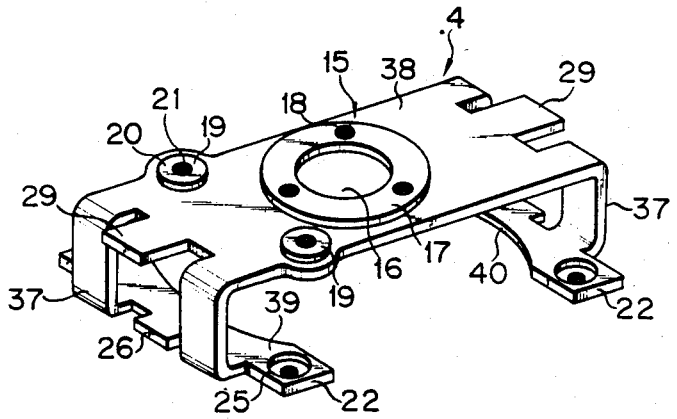
FIG. 2 is a perspective view of a frame incorporated into the closed type compressor.
Figure 3:
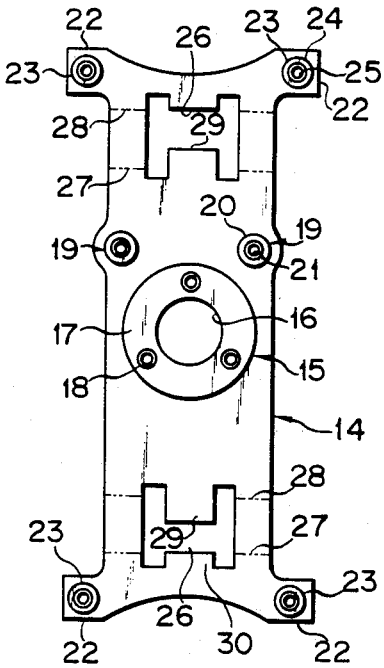
FIG. 3 is a plan view of a developed frame in the middle of its formation.
Figure 4:
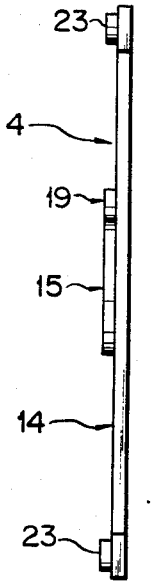
FIG. 4 is a side view of the frame shown in FIG. 3.
Figure 5:
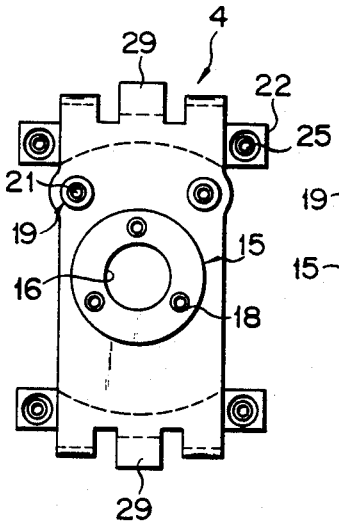
FIG. 5 is a top view of a finished frame.
Figure 6:
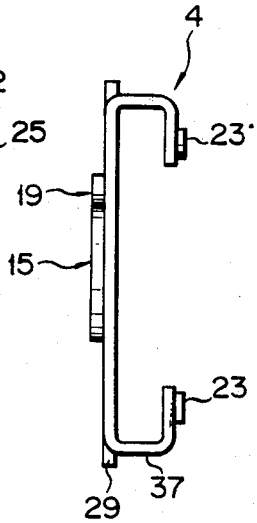
FIG. 6 is a side view of the finished frame of FIG. 5.
Figure 7:
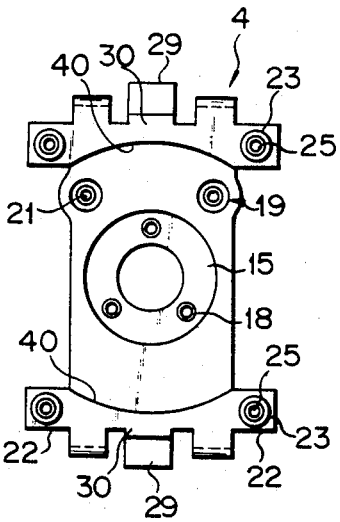
FIG. 7 is a bottom view of the finished frame of FIG. 5.

FIGS. 2 to 7 show in detail the frame 4 constituting a main part of the closed type compressor according to the present invention, FIG. 2 showing a perspective view of the entire frame 4, FIGS. 3 and 4 showing a developed one of the frame 4, and FIGS. 5 to 7 showing a plan view, side view and bottom view of the frame 4, respectively.

In FIGS. 3 and 4, the frame 4 is formed of an elongated sheet material such as an iron sheet. An embossed portion 15 for the attachment of the bearing 10 is formed at the central part of the sheet material 14. The embossed portion 15 is formed with a circular through-hole 16 for permitting the insertion of the bearing 10 and crank shaft 9 therethrough. The embossed portion 15 is made into the form of a circle concentric with the circular through-hole 16 and comprises an attachment seat 17 formed to be convex on an upper surface of the sheet material 14, and three bolting holes 18 are formed in the attachment seat 17 at a predetermined interval from each other. The bearing 10 is made cylindrical and has an attaching flange portion 10*a* at its intermediate portion. This flange portion 10*a* is formed with three holes 32 at the positions corresponding to the bolting positions 18. In the vicinity of the embossed portion 15 for the attachment of the bearing 10, two embossed portions 19 for mounting the cylinder 5 thereon are formed on the upper surface of the frame. This embossed portion 19 is also made into the form of a circle and comprises an attachment seat 20 formed convexly on the upper surface of the sheet material member, and a bolting hole 21 is formed at the center of the attachment seat 20.

At each of four corners of the substantially rectangular sheet member 14, a small piece 22 is formed integrally with the sheet member 14 in a manner that it protrudes from this member 14. Each small piece 22 is formed with an embossed portion 23 for attachment of the stator 7. This embossed portion 23 is also made convex from the upper surface of the sheet member 14 and comprises a circular attachment seat 24 and a bolting hole 25 provided at the central part of this attachment seat 24.

The surfaces of the attachment seats 17, 20 and 24 of the embossed portions 15, 19 and 23 are made smooth and flat, and are made to have the substantially same height as measured from the surface of the sheet member 14, said embossed portions 15, 19 and 23 being all simultaneously formed on the sheet member 14 by a known embossing technique. Recessed portions corresponding to the embossed portions 15, 19 and 23 are formed in the back surface of the sheet member 14.

The bolting holes 18, 21 and 25 provided in the embossed portions 15, 19 and 23 are each formed with an internal thread. Such bolting hole, however, may be a one which serves only to permit a mere insertion of a bolt therethrough.

The sheet member 14 is formed, at the portions, in the vicinity, of its ends, with substantially H-shaped punch holes 26 symmetrical with each other. Each punch hole is provided so that the sheet member 14 may be bent easily and with high precision at straight bending lines 27 and 28 extending widthwise as shown in dotted lines and no spring-back may occur after the sheet member has been bent in such manner. The punch hole 26 is formed with the tongue members 29 and 30 extending toward a center of the punch hole 26. When the frame 4 has been installed in the case 1, the tongue member 29 located to the side of the center of the sheet member 14 is located in the vicinity of an inner peripheral surface of the case and serves as a stopper for regulating horizontal movement of the frame 4 so as to compel this movement to fall within a specified range. On the other hand, the tongue member 30 located at the side of the sheetmember end serves as a keeper of the stator 7.

By bending the sheet material member 14, shown in FIGS. 3 and 4, along the lines 27 and 28 as indicated by the dotted lines toward the back side of the member through the first and second angles (each of substantially 90°, respectively), i.e., in the form of a horizontally thrown U, a frame such as that shown in FIG. 2 and FIGS. 5 to 7 is prepared.

The frame 4 thus formed is such that the embossed portion 19 for attachment of the cylinder 6 is formed on its upper surface; the embossed portion 15 for attachment of the bearing 10 for supporting the crank shaft 9 is also formed on said upper surface; and the embossed portion 23 for attachment of the stator 7 is formed on its underside. At the same time, the embossed portions 15, 19 and 23 are disposed at the positions that can be seen from below and above the frame 4.

Figure 8:
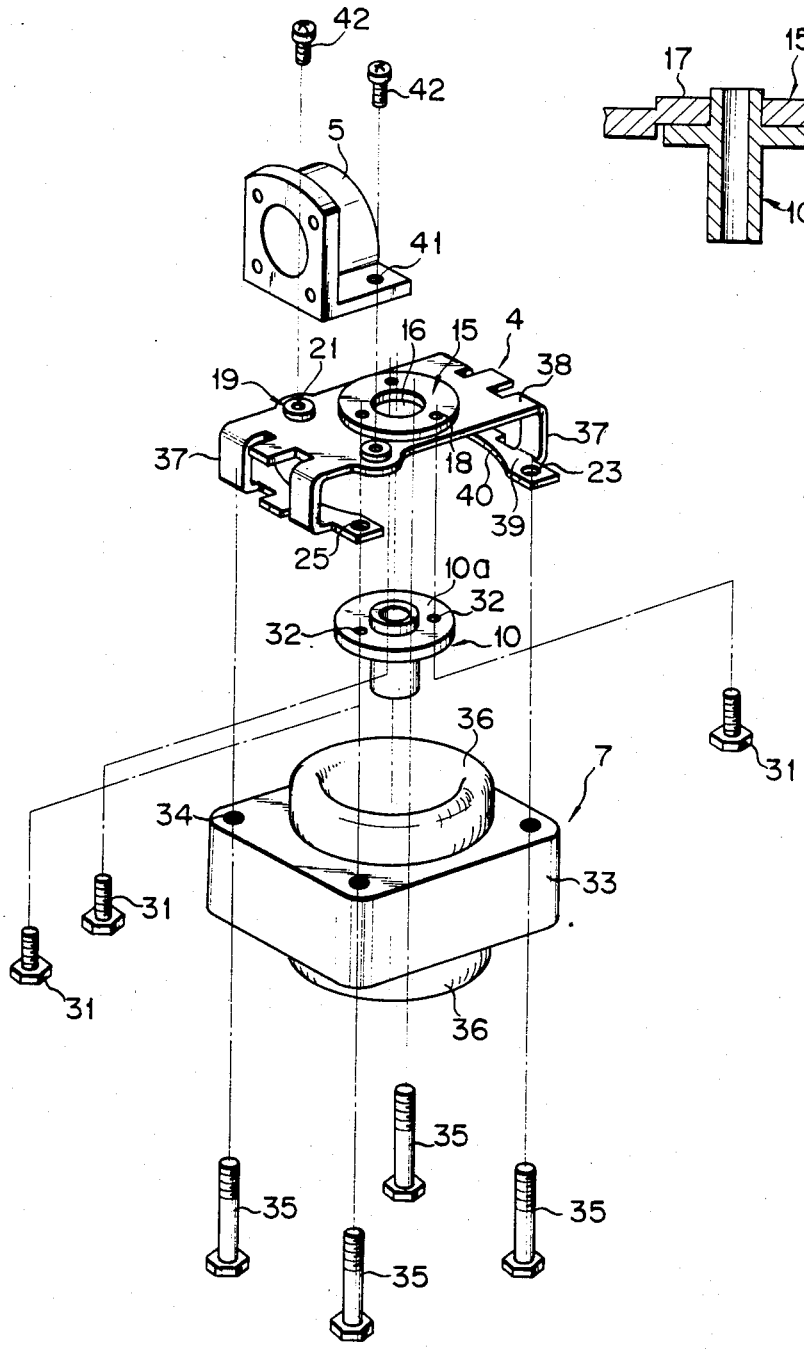
FIG. 8 is a disassembled view of a part of the closed type compressor.
Figure 9:
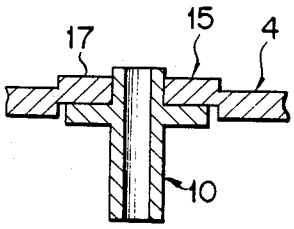
FIG. 9 is a sectional view showing the frame and a bearing.

Next, the manner in which the compression means 2 and motor means 3 are mounted on the frame 4 of the present invention will be described with reference to FIG. 8.

First of all, the upper end portion of the bearing 10 is inserted from below into the through-hole 16 of the embossed portion 15 for attachment of the bearing. Under this condition, the attaching bolts 31 are passed through the bolting holes 32 provided in the bearing 10 and screwed into the bolting holes 18 of the embossed portion 15, thereby fixing the bearing 10 to the embossed portion 15.

In attaching the stator 7 to the underside of the frame 4, attaching bolts 35 are inserted from below into the attaching holes 34 provided at the four corners of a main body 33 of the stator 7, and tip ends of these attaching bolts 35 are screwed into the bolting holes 25 of the embossed portion 23 for the attachment of the stator, thereby attaching the stator 7 to the underside of the frame 4. In this case, since motor coil ends 36 protrude from the upper and lower surfaces of the main body 33 of the stator, leg portions 37 of the bent portions of the frame 4 are so formed to have a length greater than the height of those coil ends 36, thereby preventing the motor coil ends 36 from abutting against the top 38 of the frame 4. Further, the end faces 40 of lower portions 39 of the frame 4 are previously so formed like a circular arc as to conform to the outer periphery of the coil end 36.

After attaching the bearing 10 and stator 7, the crank shaft 9 is inserted into the bearing 10 from above the same and the rotor 8 is inserted from below the crank shaft 9, whereby the rotor 8 is fixed to the crank shaft 9.

When attaching the cylinder 5 to the upper side of the frame 4, attaching bolts 42 are inserted into the attaching holes 41 provided in the cylinder 5 as shown, and the attaching bolts 42 are screwed into the bolting holes 21 of the embossed portion 19 for attachment of the cylinder, thereby attaching the cylinder 5.

Since the respective embossed portions 15, 19 and 23 are seen both from above and from below the frame 4, at the time of attaching the compression means 2 and motor means 3 the precisions involved such as the height of the surfaces of the embossed portions 15, 19 and 23 are previously checked at the final stage of forming the frame, whereby the stator 7, bearing 10 and cylinder 5 are attached.

It should be noted here that, thereafter, the piston 6 and connecting rod 12 are attached or mounted onto the cylinder 5, which is thus connected to the crank shaft 9. Further, after the compression means 2 and motor means 3 are attached onto the frame 4 in accordance with the above-mentioned procedure, the frame 4 is attached to the interior of the case 1 by means of, for example, springs, as shown in FIG. 1.

In the above-mentioned embodiment, the respective embossed portions 15, 19 and 23 were first formed on one surface of the sheet material member 14, which was then bent to form the frame 4. The invention, however, is not limited to such an example. That is to say, the ends of the sheet member 14 may be first bent in the form of a horizontally thrown U, thereby forming an original frame 4. Then, the respective embossed portions 15, 19 and 23 are formed and, thereafter, the bolting holes 18, 21 and 25 are made in the embossed portions 15, 19 and 23.

Preferably, the sheet member 14 has a thickness of approximately 3 to 6 mm and consists of metal. The invention, however, is not limited to such thickness.

Further, in the preceding embodiment, the embossed portion 23 for attaching the stator 7 was formed on the small piece 22 protruding from each of the four corners of the sheet member 14 so as to permit the embossed portion 23 to be seen both from above and from below the frame 4. However, the embossed portion 23 may be of any shape if it can he seen from above and from below the frame.

(Effects of the Invention)

As will be understood from the foregoing detailed description, the present invention has the following excellent effects.

(1) Since the frame according to the invention is formed of a sheet material member and yet the embossed portions for attaching the compression means and motor means are formed on the sheet member, it is possible to attach the compression means and motor means with high precision.

(2) Since the frame can be formed simply by applying the embossing and bending operations with respect to the sheet material, it can be readily fabricated.

(3) The frame can be simply prepared even if the sheet material therefor has a greater thickness, so that a frame having a rigidity in terms of mechanical strength can be obtained.

(4) Since the respective embossed portions are disposed at the positions at which they can be seen by the eye from above and below the frame, the precisions thereof can be easily checked at the final stage of forming the frame.

(5) Since the frame of the invention can be formed of sheet material, the resultant frame is small in size, light in weight and simple in structure, and it can be manufactured at a cost equal to about ⅓ that of the conventional frame formed by castings.

(6) The attachment of the stator can be more simply effected by forming the embossed portion for attaching the stator with respect to the small piece protruding from the sheet material in the mentioned manner.

What is claimed is:

1. A closed type compressor comprising:

a case;

a frame provided within said case;

a compressor and an electric motor both attached to said frame;

said frame being U-shaped and comprising an elongated sheet material member and a plurality of embossed portions integrally formed at positions of said sheet material member where said compressor and electric motor attach respectively thereto, and each of said portions having a through hole;

said sheet material member comprising a central portion, bent leg portions defined by end portions of said sheet material member which are substantially perpendicular, and ends defined by tip ends of said leg portions angled substantially perpendicular to said leg portions so as to face said central portion, with said embossed portions formed on said central portion and said ends of said sheet member, respectively, being formed at said positions so that said respective through holes thereof are not in axial alignment;

fixing means which pass through the through holes for fixing said motor and compressor on their respective embossed portions; and means for supporting said frame within said case so that said central portion of said sheet member is pointed in a direction opposite to said ends thereof.

2. A compressor as in claim 1, wherein said bent leg portions define a generally H-shaped punch hole, an upper side thereof constituting an unbent tongue member defining stopper means for regulating horizontal movement of said frame within said case.

3. A compressor as in claim 1, wherein said plurality of embossed portions include at least four embossed portions formed respectively at four corners of said bent leg portions for said attachment of said electric motor thereby, and wherein said bent leg portions provide separation between said electric motor and said central portion of said frame so as to facilitate said attachment of the former to the latter.

4. A closed type compressor according to claim 1, wherein said compressor is attached onto said embossed portion formed at said central portion of said sheet member and said motor is attached onto said embossed portions formed at said ends thereof.

5. A closed type compressor according to claim 4, wherein said compressor and said motor are attached onto said embossed portions by said fixing means which comprise bolts screwed respectively into said compressor and motor through said through holes.

6. A closed type compressor according to claim 5, wherein all of said embossed portions are formed in such a manner as to be convex at one side surface of said sheet member and concave at the other side surface thereof.

7. A closed type compressor according to claim 6, wherein said sheet member is formed of a substantially rectangular metal sheet having a thickness of 3 to 6 mm.

* * * * *